United States Patent [19]

Schwarze

[11] Patent Number: 4,788,845

[45] Date of Patent: Dec. 6, 1988

[54] PIPE BENDING MACHINE

[76] Inventor: Rigobert Schwarze, Olpener Strasse 460-474, 5000 Cologne 91, Fed. Rep. of Germany

[21] Appl. No.: 73,961

[22] Filed: Jul. 15, 1987

[30] Foreign Application Priority Data

Aug. 13, 1986 [DE] Fed. Rep. of Germany ..... 3627502

[51] Int. Cl.[4] ..... B21D 7/04

[52] U.S. Cl. ..... 72/157; 72/159

[58] Field of Search ..... 72/149, 150, 154, 155, 72/157, 159, 320, 321; 269/32, 93, 137, 138, 217

[56] References Cited

U.S. PATENT DOCUMENTS

| | | | |
|---|---|---|---|
| 1,417,294 | 5/1922 | Berkeley | 269/32 X |
| 3,299,681 | 1/1967 | Hautau | 72/157 |
| 4,063,441 | 12/1977 | Eaton | 72/155 X |
| 4,236,398 | 12/1980 | Schwarze | 72/157 |
| 4,495,788 | 1/1985 | Traub | 72/157 |

FOREIGN PATENT DOCUMENTS

| | | | |
|---|---|---|---|
| 1962590 | 6/1971 | Fed. Rep. of Germany | 72/157 |
| 2101162 | 7/1972 | Fed. Rep. of Germany | 72/157 |
| 2910174 | 9/1980 | Fed. Rep. of Germany | 72/157 |

*Primary Examiner*—E. Michael Combs
*Attorney, Agent, or Firm*—Michael J. Striker

[57] ABSTRACT

A pipe bending machine comprises a longitudinally extending machine frame having an upper side, a feeding carriage movable at an upper side of the machine frame and carrying device for clamping a pipe, a bending head provided on one end of the machine frame and rotatable about a vertical axis, a bending template mounted on the bending head and formed as a multilevel template having a plurality of bending grooves provided with different bending diameters and arranged at different levels, a device cooperating with the bending template for bending a pipe therebetween, the bending template and the displacing carriage with the clamping sleeve being movable relative to one another in a vertical direction and transversely to a longitudinal direction of the machine frame for using one or another of the bending grooves, the bending template being liftable and lowerable in the vertical direction for exchanging the bending grooves, while the feeding carriage being moved transversely in the longitudinal direction of the machine frame.

12 Claims, 7 Drawing Sheets

PIPE BENDING MACHINE

BACKGROUND OF THE INVENTION

The present invention relates to a pipe bending machine. More particularly it relates to a pipe bending machine which has an elongated machine frame, a feeding carriage movable in the region of an upper longitudinal edge of the machine frame and carrying a clamping sleeve which clamps a pipe, a bending table provided at a head end of the machine frame and turnable about a vertical axis as well as supporting a bending template, and a turning arm with a clamping device and a clamping jaw as well as a sliding rail provided in the region of an upper longitudinal edge at the side of the feeding carriage and both cooperating with the bending template.

Pipe bending machines of this type are known in the art. In a known pipe bending machine the bending template is formed as a multilevel template provided with a plurality of bending grooves which are arranged over one another and have with different bending radii for bending pipes, and the claimed jaw has a clamping surface which corresponds to the countour of the bending template. Furthermore, for utilization of one or another bending groove of the bending template, a relative displacement between the feeding carriage with the clamping sleeve and the bending template is performed in a vertical direction and transversely to the longitudinal direction of the machine.

In known pipe bending machines of this type it was proposed to raise and lower the bending template in a vertical direction and simultaneously move the same transversely to the longitudinal direction of the machine frame, while the feeding carriage with the clamping sleeve which carries the pipe to be bent remains movable in direction toward the pipe to be bent, and for bending with the multilevel template does not move transversely to the machine frame or to the pipe to be bent.

In accordance with another known solution the bending head with its drive as well as the bending template remain still, and the feeding carriage with the clamping sleeve which carries the pipe is movable upwardly and downwardly in the vertical direction, and also transversely to the longitudinal direction of the machine frame.

Still a further solution proposes to operate with stationary pipe or pipe movable in an axial direction by the feeding carriage, while the bending head moves transversely to the longitudinal direction of the machine frame, and the bending template is supported inside the movable bending head raisable and lowerable in the vertical direction.

All above proposed solutions have the disadvantage in that they require a high structural expenses. It is difficult to arrange all elements which are needed for driving in the vertical direction and in the direction transverse to the longitudinal direction of the machine frame, and because of great movable masses they must have significant dimensions.

SUMMARY OF THE INVENTION

Accordingly, it is an object of the present invention to provide a pipe bending machine which avoids the disadvantages of the prior art.

More particularly, it is an object of the present invention to provide a pipe bending machine in which a relative movement between a bending head and the feeding carriage with the clamping sleeve is simple structurally and has a lower weight.

In keeping with these objects and with others which will become apparent hereinafter, one feature of the present invention resides, briefly stated, in a pipe bending machine in which for exchanging of bending grooves, a bending template is supported so that it is lowerable and liftable relative to a machine frame in a vertical direction and a feeding carriage is movable transversely to a longitudinal direction of the machine frame.

When the pipe bending machine is designed in accordance with the present invention, and the bending head with the bending template is movable in the vertical direction while the transverse movement is performed by the feeding carriage with the clamping sleeve and thereby with the positioning device, a subdivision of the two different movements is performed in two different movement devices arranged at different locations. Since the two movement devices are structurally different units at different locations of the pipe bending machine, they are individually of a therefore have individually a low mass.

The above mentioned movement devices are separate devices at different locations of the pipe bending machine. There is no difficulty in their structural arrangement, so that they do not interfere with one another. Finally, the inventive solution provides an unobjectionable arrangement of such tools and devices which are needed or desirable for a pipe bending. It is required to provide a turning arm with a clamping device and a clamping jaw, also in some cases a sliding rail, and in some cases also a fold smoother.

In accordance with a further feature of the present invention, the bending head with the bending template and their drive, the turning arm with the clamping device and the clamping jaw, as well as the sliding rail together form a structural unit which is jointly lowerable and raisable on the machine frame. This solution provides for an especially simple vertical movement of the bending head.

An especially simple construction is provided when the bending head is mounted as a structural unit of the bending template, the turning arm, the sliding rail on the machine frame, and the mounting is supported lowerably and raisably on the machine frame.

In accordance with a further feature of the present invention, the mounting is provided on a vertical side wall of the machine frame. In particular, two cylindrical vertical guides can be provided on the machine frame, and a beam which carries the above structural unit of the bending template, turning arm and sliding rail engages the guides and is liftable and lowerable by a cylinder-piston unit arranged between the guides.

It is especially advantageous when the cylinder-piston unit has a cylinder formed in the beam and having a piston with a piston rod fixedly connected with the machine frame, while the piston is actuatable by oil from both sides.

In a further feature of the invention when the multilayer template is used, the clamping jaw is formed as a cantilever which is turnable about a horizontal axis on the clamping device of the turning arm. The clamping jaw is provided with a plurality of clamping grooves arranged above one another.

In accordance with a further feature of the invention, the bending template or its support is provided with an inclined sliding surface such that during movement of the clamping jaw its support or cantilever slides upwardly and therefore the sliding surface determines the height of the clamping jaw.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
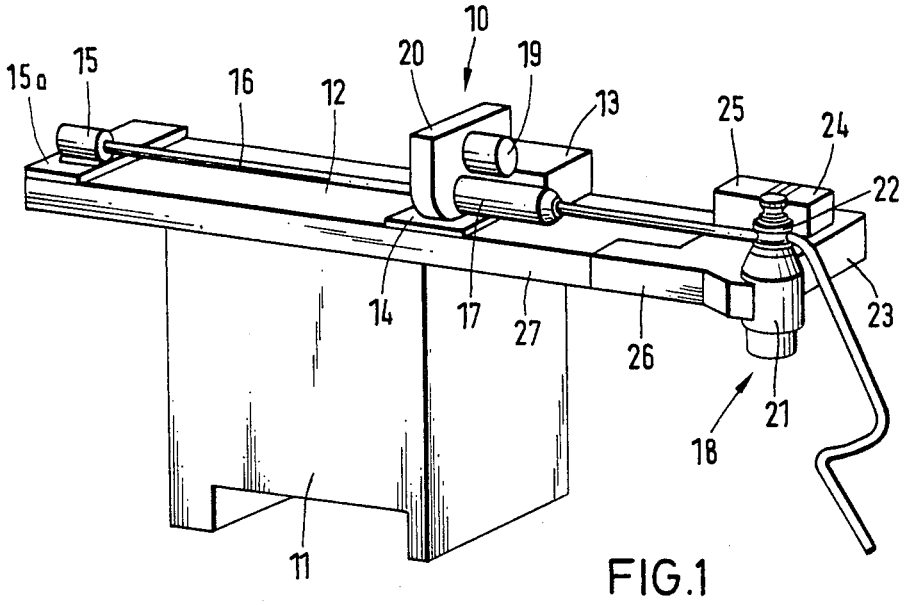
FIG. 1 is a perspective view of a pipe bending machine in accordance with the present invention.

A pipe bending machine in accordance with the present invention is identified as a whole with reference numeral 10. It includes a lower frame 11 with a horizontally extending box-shaped support 12 which is arranged on the upper surface of the frame 11. The support 12 extends at its both ends beyond the frame 11 and forms a machine frame. A feeding carriage 13 moves on the upper side of this machine frame and is movably supported on conventional rails which are not shown in the drawings. The feeding carriage 13 travels on a guide 14 transversely to the longitudinal direction of the machine frame 12 by means of an associated known drive.

A post-pressing device is identified with reference numeral 15. It is arranged on a rail 15' and travels simultaneously with the feeding carriage. The post-pressing device can also be formed as a device for bending with a mandrel inside a pipe 16 which is supported by a clamping sleeve 17 of the feeding carriage and moved in direction toward a bending head 18. Simultaneously the pipe 16 is rotated by means of the clamping sleeve as shown in FIG. 1, so that bending of the pipe can be performed in several planes. A drive motor is identified with reference numeral 19. It is arranged on a housing 20 and activates the clamping sleeve 17. The unit including the feeding carriage, the clamping sleeve, and the drive is identified in practice as a positioning device.

The bending head 18 has a drive motor 21 which rotates a multilevel template 22. The multilevel template can have a plurality of vertically spaced bending radii of different diameter which are smaller or greater in correspondence with the selection of the groove in the pipe 16. A turning arm 23 with a clamping device 24 is mounted on the bending head. A clamping jaw which will be described in detail later on is mounted on the clamping device 24. A sliding rail pressing element is identified with reference numeral 25. The unit including the bending head 18 with the bending template, the clamping device and the sliding rail pressing element is provided with a bar 26 which is mounted on a vertical side 27 of the machine frame 12 and extends into it.

Figure 2:
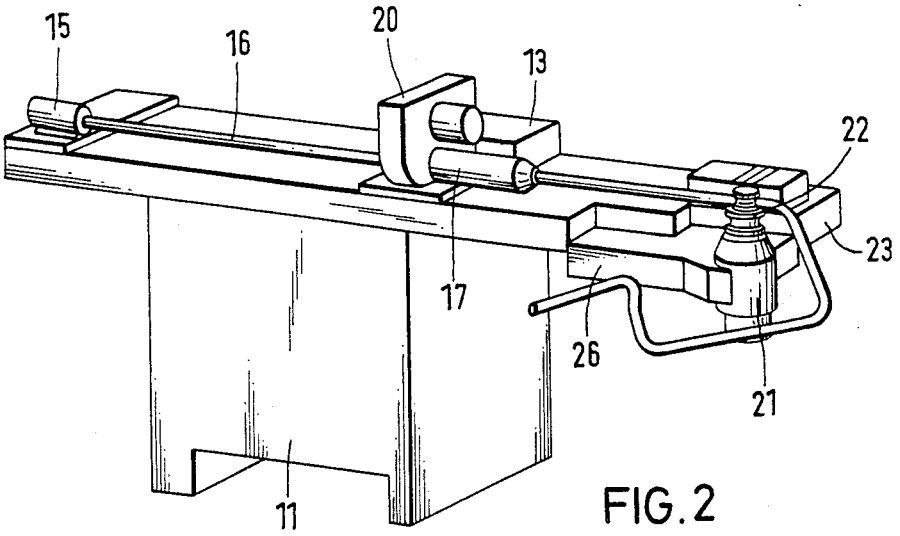
FIG. 2 is a view showing the pipe bending machine of FIG. 1 with another position of a bending head.

FIG. 1 shows the bending head 18 in its upper position. FIG. 2 shows the bending head 18 in its downwardly moved position. Simultaneously, also the positioning device has been displaced.

FIG. 2 shows that the positioning device moves transversely until it is close to the vertical side wall 27 and assumes another position which is not shown in the drawing. The vertical adjustment of the bending head with the unit of the bending template 22, turning arm 23, and the sliding rail 25 is performed in the shown example at the location of mounting on the machine frame 12 as shown in FIGS. 1 and 2, and more particularly illustrated in FIGS. 3 and 4.

Figure 4:
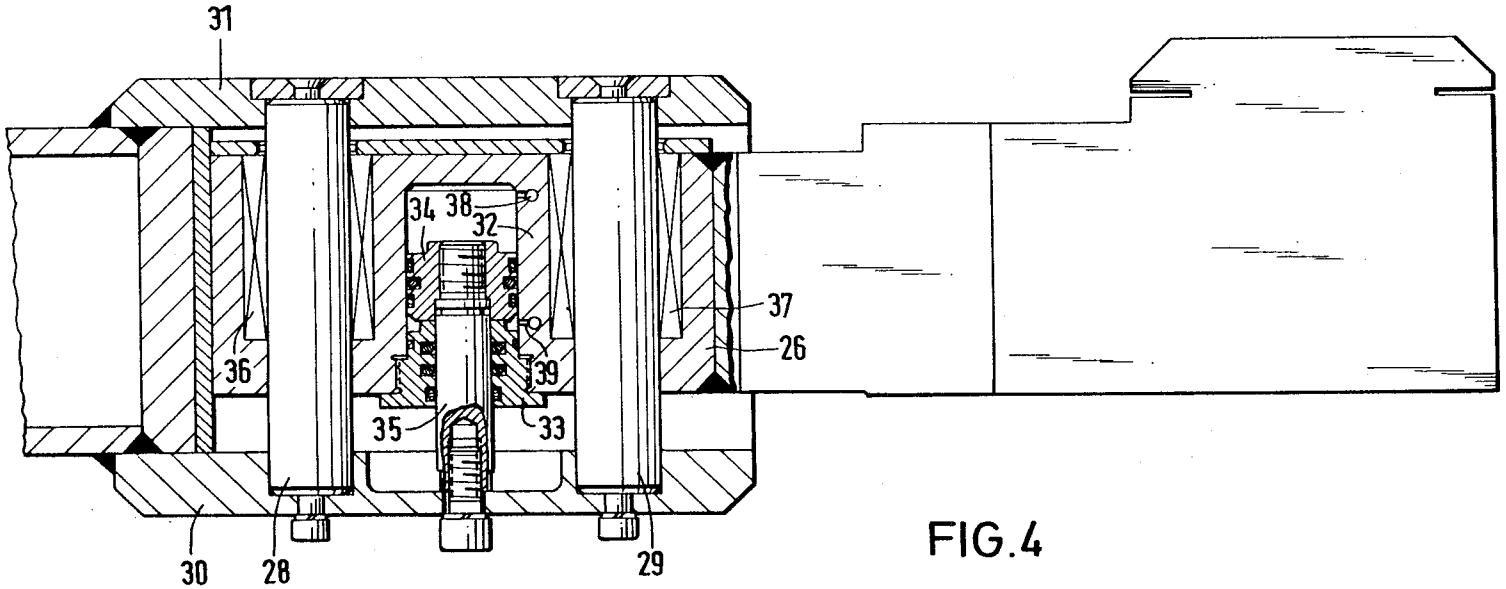
FIG. 4 is a view showing a vertical section along the line IV—IV in FIG. 3 with a raised bending head.

FIG. 4 shows both cylindrical guides 28 and 29 mounted on the machine frame 12 and supported on plates 30 and 31 of the machine frame. A cylinder 32 is formed in the beam 26 and is closed by a collar 32 provided with a plurality of seals. A piston 34 is located in the cylinder 32 and is also provided on its periphery with a plurality of seals. A piston rod 35 is mounted in the plate 30 of the machine frame. The cylindrical guides are surrounded by sliding bushes 36 and 37.

FIG. 4 shows the lifted position of the bending head, while oil was pumped through an inlet opening 38 into the upper cylinder chamber. When as shown in FIG. 5 oil is pumped through a lower inlet 39 to another piston side, the beam is lowered in correspondence with the showing of FIG. 5.

Figure 5:
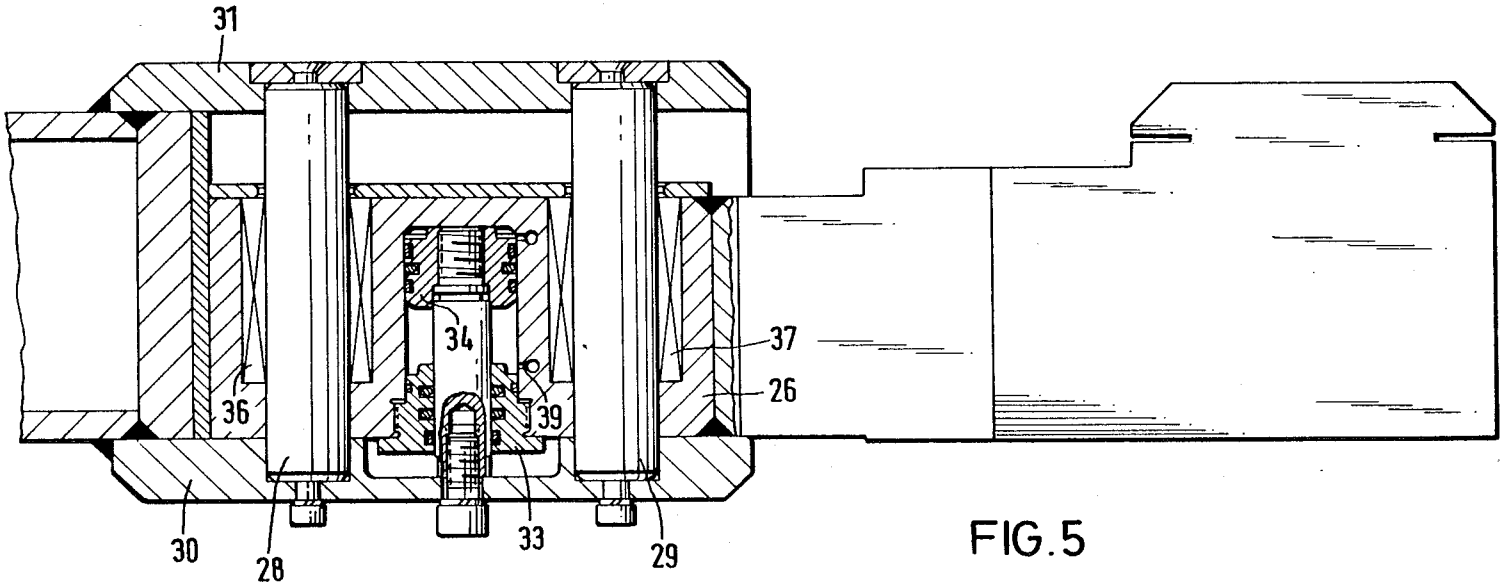
FIG. 5 is a view corresponding to the view of FIG. 4 but showing the lowered bending head.

FIGS. 4 and 5 show that the mounting device for mounting the bending head on the beam of the machine frame is formed simultaneously as lifting and lowering device.

Figure 6:
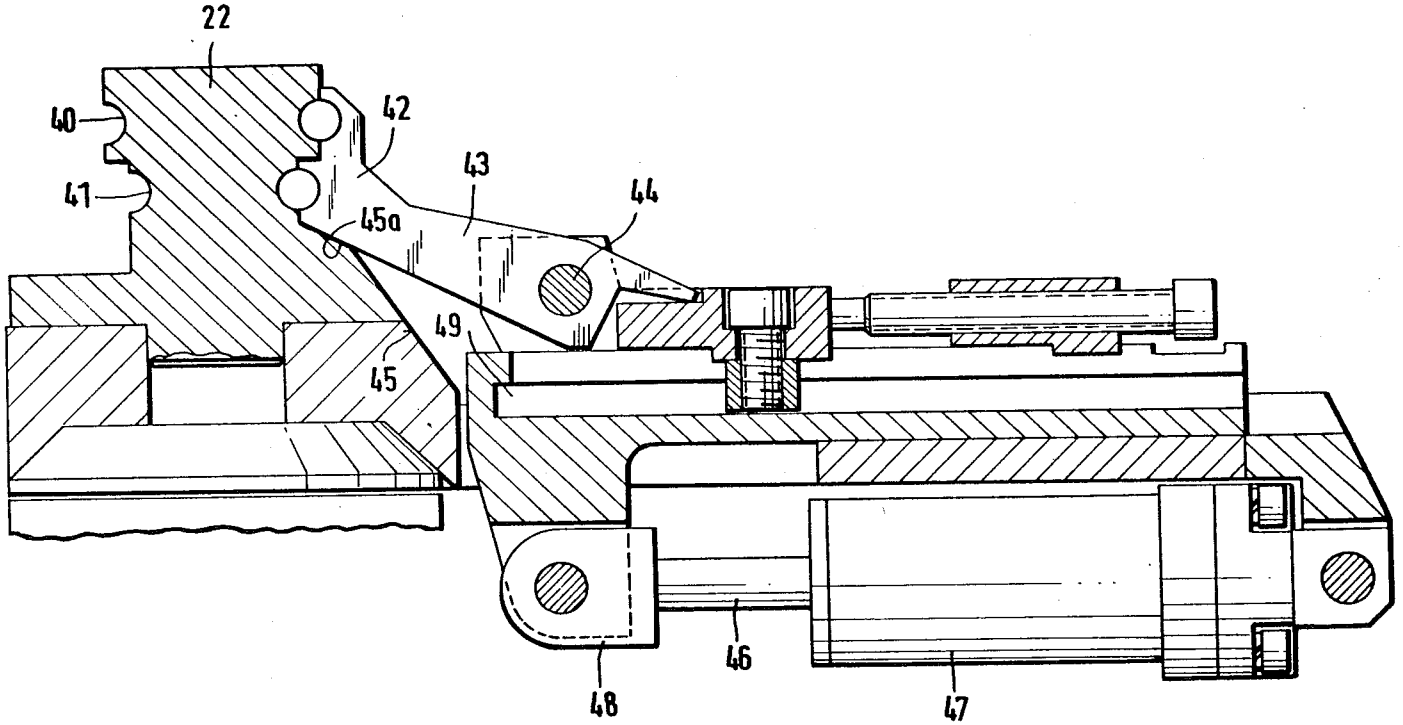
FIG. 6 is a vertical section of the bending template with the clamping device.

FIG. 6 shows the bending template 20 with different bending grooves 40 and 41 provided on different heights and being in this region straight for clamping by means of a clamping jaw 42. It is to be understood that more than two shown bending grooves can be provided. Finally, in deviation from the showing of FIG. 6, the upper groove 40 can be with a smaller bending radius while the lower groove 41 can be with a greater bending radius.

Figure 7:
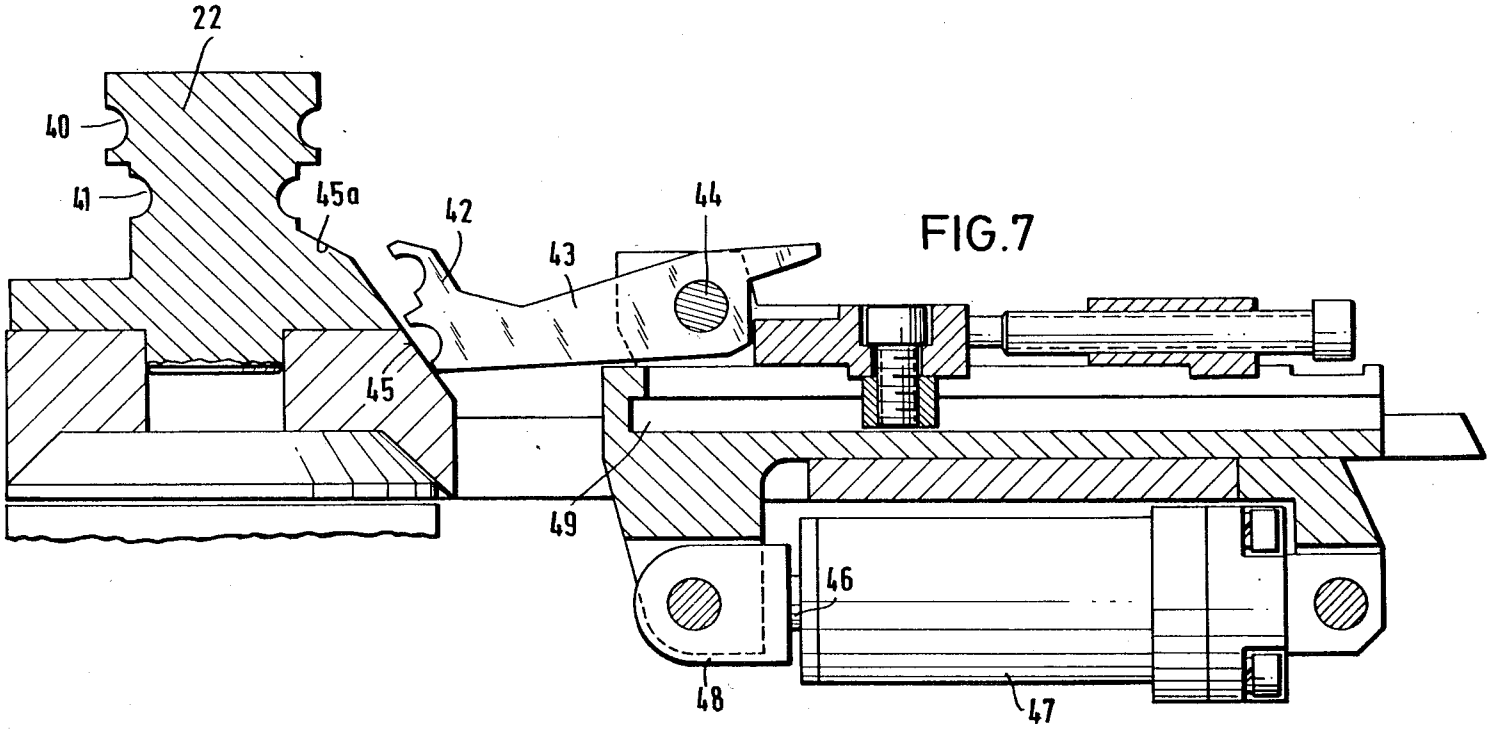
FIG. 7 is a view corresponding to the view of FIG. 6 with a retracted clamping device.

The clamping jaw 42 is supported on a lever 43 turnable about a horizontal axis 44 of the clamping device. The bending template or its holder is provided with a sliding surface 45 or **45*a* on which during movement of the clamping jaw it is lifted. By means of the portion 45*a*, the height position of the clamping jaw 42 is determined. When the clamping device as shown in FIG. 7 is withdrawn by insertion of the piston rod 46 into the cylinder 47, wherein a sliding surface 49 for the clamping device is mounted on the front head 48 of the piston rod, then the lever 43 tilts about the horizontal axis 44 downwardly so that the clamping jaw 42 moves under the region of the bending grooves and thereby the bent pipe can be simply withdrawn from the bending template without encountering any obstacle from the clamping jaw. It is to be understood that with movement of the clamping jaw onto the bending template, the clamping jaw is lifted via the lever 43 and the sliding surface 45 and 45*a*** to the working position.

Figure 3:
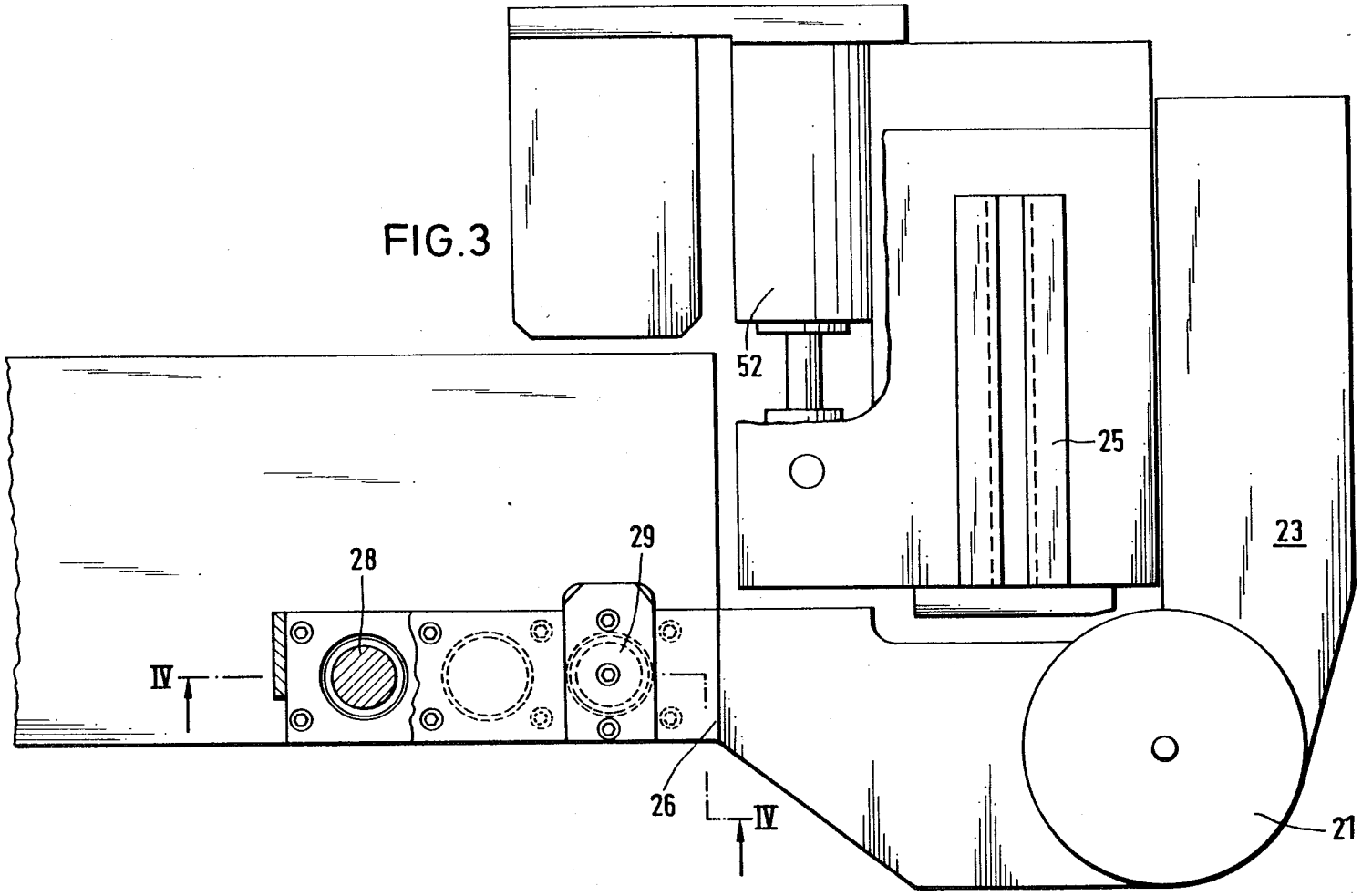
FIG. 3 is a view showing the bending head with its mounting on a plan view.
Figure 8:
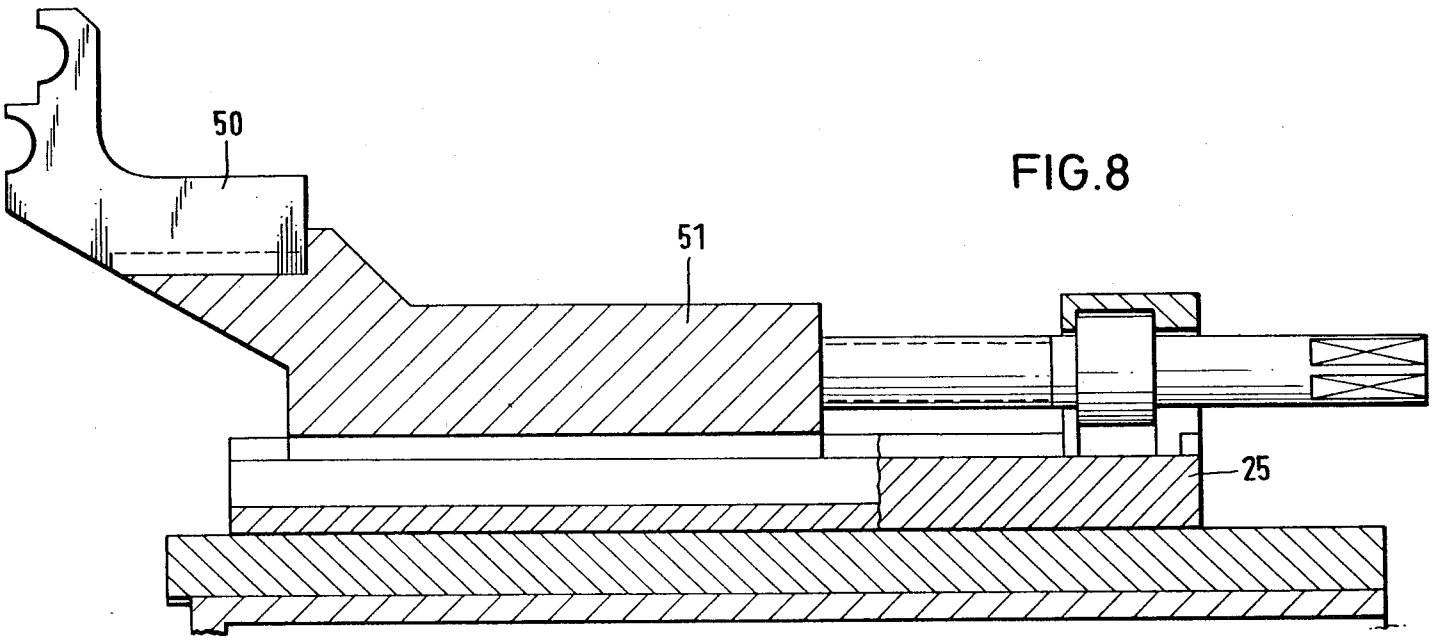
FIG. 8 is a view showing a vertical section through a sliding rail device.

FIG. 8 shows a sliding rail 50 which is movable by a support 51 on the sliding rail 25 shown in FIG. 3 via a cylinder-piston unit 52 shown in FIG. 3.

It will be understood that each of the elements described above, or two or more together, may also find a useful application in other types of constructions differing from the types described above.

While the invention has been illustrated and described as embodied in a pipe bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pipe bending machine, comprising a longitudinally extending machine frame having an upper side; a feeding carriage movable at an upper side of the machine frame and carrying means for clamping a pipe; a bending head provided on one end of said machine frame and rotatable about a vertical axis; a bending template mounted on said bending head and formed as multi-level template having a plurality of bending grooves provided with different bending diameters and arranged at different levels, said bending template having also a clamping surface; means cooperating with said bending template for bending a pipe therebetween, said cooperating means having a turning arm provided with a clamping jaw which has a clamping surface corresponding to said clamping surface of said bending template and provided with several clamping grooves arranged at different levels, said bending head and said feeding carriage with said clamping means being movable relative to one another in a vertical direction and transversely to a longitudinal direction of said machine frame for using one or another of said bending grooves, so that said bending template is liftable and lowerable in the vertical direction for exchanging said bending grooves and not movable transversely to the longitudinal direction of the machine frame, while said feeding carriage is movable transversely to the longitudinal direction of the machine frame and not liftable and lowerable in the vertical direction, said clamping jaw having a supporting lever, said bending template having an inclined sliding surface formed so that said supporting lever slides upwardly along said sliding surface during movement of said clamping jaw toward said bending template so that said sliding surface elevates said clamping jaw into a clamping position adjacent the bending grooves of said bending template.

2. A pipe bending machine machine as defined in claim 1, wherein said clamping means on said feeding carriage is formed as a clamping sleeve arranged to clamp the pipe.

3. A pipe bending machine as defined in claim 1, wherein said feeding carriage has a side and an upper longitudinal edge, said means cooperating with said bending template including a sliding rail which is provided on said upper longitudinal edge at the side of said feeding carriage.

4. A pipe bending machine as defined in claim 1; and further comprising a drive provided for driving said bending head with said bending template.

5. A pipe bending machine as defined in claim 4, wherein said bending head with said bending template and said drive, said turning arm with said clamping jaw, and said sliding rail together form a structural unit which is jointly lowerable and liftable on said machine frame.

6. A pipe bending machine as defined in claim 5, wherein said bending template, said turning arm, said sliding rail are provided with respective drives, said structural unit with said drives being mounted on said machine frame; and further comprising means for mounting said unit with said drives and supported so that said means is liftable and lowerable.

7. A pipe bending machine as defined in claim 6, wherein said machine frame has a vertical side wall, said means for mounting being arranged on said vertical side wall.

8. A pipe bending machine as defined in claim 7, wherein said mounting means are arranged in said side wall of said machine frame.

9. A pipe bending machine as defined in claim 6, wherein said machine frame is provided with two cylindrical vertically extending guides; and further comprising a beam which supports said unit and engages said guides; and a cylinder-piston unit arranged between said guides and operative for lifting and lowering said beam.

10. A pipe bending machine as defined in claim 9, wherein said cylinder-piston unit includes a cylinder enclosed in said beam, a piston arranged in said cylinder, and a piston rod extending from said piston and fixedly connected with said machine frame, said piston being actuatable by oil from its both sides.

11. A pipe bending machine as defined in claim 1; and further comprising a horizontal axle provided on said turning arm, said lever being mounted on said horizontal axle of said turning arm.

12. A pipe bending machine as defined in claim 1, wherein said bending template has a support, said support of said bending template being provided with said inclined sliding surface.

* * * * *